United States Patent [19]

Naumann et al.

[11] Patent Number: 4,936,261

[45] Date of Patent: Jun. 26, 1990

[54] APPARATUS FOR INTRODUCING A FUEL ADDITIVE TO THE FUEL TANK OF AN AUTOMOTIVE VEHICLE

[75] Inventors: Fritz Naumann, Stammham; Herwig Reim, Buxheim; Hans-Günther Haldenwanger, Ingolstadt, all of Fed. Rep. of Germany

[73] Assignee: Audi AG., Ingolstadt, Fed. Rep. of Germany

[21] Appl. No.: 341,627

[22] Filed: Apr. 21, 1989

[30] Foreign Application Priority Data

May 6, 1988 [DE] Fed. Rep. of Germany ..... 3815523

[51] Int. Cl.[5] ..... F02B 75/12

[52] U.S. Cl. ..... 123/1 A; 123/198 A

[58] Field of Search ..... 123/1 A, 198 A

[56] References Cited

U.S. PATENT DOCUMENTS

| | | | |
|---|---|---|---|
| 4,596,277 | 6/1986 | Djordjevic | 123/1 A |
| 4,621,593 | 11/1986 | Rao et al. | 123/1 A |
| 4,727,827 | 3/1988 | Hoffman et al. | 123/1 A |

*Primary Examiner*—E. Rollins Cross

*Attorney, Agent, or Firm*—Karl Hormann

[57] ABSTRACT

An apparatus for introducing a fuel additive into the fuel tank of an automotive vehicle comprising a pumping device including a pneumatically actuated displacement pump the pumping element of which is displaceable by pressure against the force of a pretensioned spring by means of a control valve and the control valve is preferably directly actuable by the lid of the fuel tank.

20 Claims, 1 Drawing Sheet

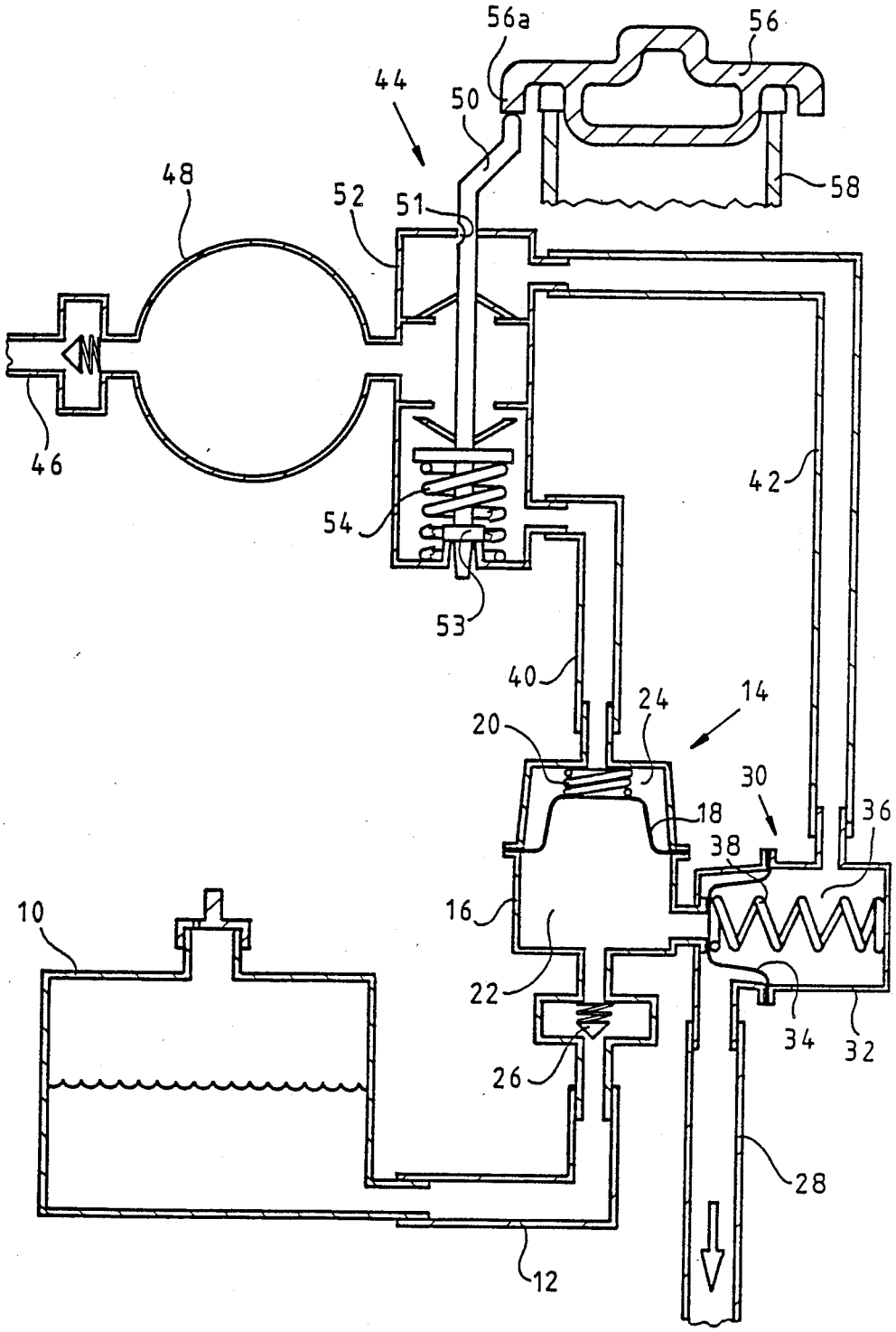
56a
56
44
50
48
52
51
58
46
42
54
53
40
24
14
20
30
18
36
38
10
16
22
34
32
26
28
12

APPARATUS FOR INTRODUCING A FUEL ADDITIVE TO THE FUEL TANK OF AN AUTOMOTIVE VEHICLE

BACKGROUND OF THE INVENTION

The invention in general relates to an apparatus for transferring a measured quantity of fluid from one container into another and, more particularly, to an apparatus for introducing a fuel additive from a reservoir into the fuel tank of an automotive vehicle.

In some countries automotive fuels, such as gasoline or diesel oil, may be of a quality which may lead to malfunctions of the engine, for instance from fuel sediments or thickening under low ambient temperatures, so that adding fuel additives may be indicated.

SUMMARY OF THE INVENTION

It is, therefore, an object of the invention to provide a simple and inexpensively built apparatus for adding a sufficiently precise amount of additive to fuel contained in an automotive fuel tank.

A further object of the invention resides in the provision of such an apparatus which dispenses a predetermined amount of fuel additive from a reservoir thereof and introduces it into the fuel tank of an automotive vehicle.

Yet another object of the invention resides in the provision of such an apparatus which adds a proper dosage of additive to the fuel after every filling of the fuel tank of a vehicle.

Other objects of the invention will in part be obvious and will in part appear hereafter.

In accordance with the invention there is provided an apparatus for introducing a fuel additive from a reservoir thereof into the fuel tank of an automotive vehicle by means of a pumping device including a pneumatically actuated displacement pump the movable pumping element of which is displaceable under pressure by way of a control valve against the force of a pretensioned spring, and in being displaced the pumping element moves a predetermined amount of additive by changing the volume of a chamber connected with the reservoir and the fuel tank, check valves being provided between the reservoir and the chamber as well as between the chamber and the fuel tank.

In a preferred embodiment of the invention the displacement pump comprises a diaphragm pump which may be actuated by vacuum pressure, a vacuum pressure storage container being provided between the control valve and the source of vacuum pressure.

In accordance with the invention a source of pressure, such a source of vacuum pressure, of the kind conventional in automotive vehicles may be utilized for driving the displacement pump. The essential elements of the apparatus in accordance with the invention are a control valve, a displacement pump, appropriate connecting lines and two check valves. In an especially advantageous embodiment of the invention the control valve may be directly actuated by the lid of the fuel tank so that additive is automatically added to the fuel each time the fuel tank is opened.

The invention accordingly comprises the system, apparatus and method possessing the features, technique and properties which are exemplified in the description to follow, and the scope of the invention will be indicated in the appended claims.

BRIEF DESCRIPTION OF THE DRAWING

The single drawing schematically depicts an apparatus in accordance with the invention including a diaphragm pump actuated by vacuum pressure and a two-way control valve.

As shown the apparatus is provided with a reservoir 10 for the additive to be added to the fuel. Persons skilled in the art are assumed to be sufficiently familiar with additive of the kind under consideration. It may be a liquid used to increase the octane rating of the fuel, to prevent thickening of the fuel under low ambient temperatures, to forestall the formation of sediments in the fuel tank, or to prevent the formation of water deposits in fuel lines, for instance. In a manner not shown the reservoir 10 may be provided with means well known in the art for indicating quantity of additive in the reservoir 10.

The reservoir 10 is connected to pumping means, shown as a diaphragm pump 14, by way of a line 12. The diaphragm pump 14 comprises a housing 16, an elastic diaphragm 18 functioning as the displaceable pumping element and a spring 20 biasing the diaphragm 18 in one direction. The diaphragm 18 divides the housing 16 into two chambers 22 and 24.

The line 12 is connected to chamber 22. A check valve 26 is provided in the line 12. In the direction of the chamber 22 the check valve 26 is open. In the opposite direction it is closed, however. Another line 28 provided with a controllable check valve 30 is also connected with the chamber 22.

The check valve 30 is provided with a housing section 32 and a diaphragm 34 and thus forms a closed chamber 36. A spring 38 biases the diaphragm 34 into a closing position with a valve seat.

By means of line 28 additive may be introduced either directly into the fuel tank, into its filling nozzle, or into a fuel flow back line of an internal combustion engine (neither shown).

The chamber 24 of the diaphragm pump 14 and the chamber 36 of the controllable check valve 30 are respectively connected to a two-way valve 44 by lines 40 and 42. The valve 44 is also connected to a source of pressure, preferably vacuum pressure by way of a line 46 provided with a pressure container 48. The source of vacuum pressure may be a vacuum pump as conventionally used in power brakes or the fuel intake tube of a carburetor.

The control valve 44 is provided with a plunger 50 extending from a housing 52 of the valve 44. A spring 54 is coiled around the stem of the plunger 50 and biases it into an operative position (not shown) in which the chamber 24 of the diaphragm pump 14 is vented through a valve 53 by way of line 40 and in which the chamber 36 of the controllable check valve 30 is subjected to vacuum pressure by way of the line 42. Vacuum pressure in chamber 36 results in the valve 34 being open. The plunger assumes this position whenever the lid 56 shown as a screw cap is removed from the filling nozzle 58 of the fuel tank (not shown), for instance when the tank is to be filled.

When the fuel tank is closed, that is when the cap 56 has been screwed onto the nozzle 58, the plunger 50 is moved into its other operative position (as shown in the drawing) by engagement with the annular flange **56*a* of the cap 56. In this position the chamber 36 of the valve 30 is vented by way of line 42 and a vent hole 51, and the chamber 24 of the diaphragm pump 14 is connected to vacuum pressure by way of line 40**.

The apparatus functions in a manner substantially as follows:

When the fuel tank is closed, i.e. when the cap 56 is screwed onto the filling nozzle 58, the chamber 24 of the diaphragm pump 14 is subjected to vacuum pressure by way of the two-way control valve 44. Thus the diaphragm 18 is moved upwardly against the bias of the spring 20. The increase in volume of the chamber 22 resulting therefrom causes the check valve 26 to be opened to admit fuel additive from the reservoir 10 to the chamber 22. If for some reason there is a failure in vacuum pressure the force of the spring 20 is too weak to open the check valve 30 against the bias of its spring 38. Thus, additive is prevented from being accidentally admitted to the fuel tank.

When, for filling the fuel tank, the cap 56 is removed from the filling nozzle 58, the control valve 44 assumes its other operative position in which the line 40 and the chamber 24 are vented, and in which the line 42 and the chamber 36 are subjected to vacuum pressure. The valve 30 now opens by movement of its diaphragm 34 against the bias of the spring 38, and the diaphragm 18 in the pump 14 moves downwardly under the bias of its spring 20 and pumps the predetermined amount of additive in the chamber 22 into the fuel tank by way of the line 28.

The amount of additive pumped from the chamber 22 during filling of the fuel container may be measured to be just about adequate to yield the desired result even for the maximum fuel capacity of the tank. Adding an over dose of additive (statistically fuel tanks are refilled when they are about ⅔ empty) is thus prevented. To prevent the adding of additive to the fuel when the tank is opened for purposes other than filling, the plunger 50 of the valve 44 may, of course, be provided with locking means, such as a lever or a valve (not shown). It would also be possible to provide a marker on the tank cap 56 drawing attention to the connection between opening of the tank and the adding of additive.

In a manner not shown the valve 44 may be mounted directly on the fuel tank or on the filling nozzle 58, either by itself or as an integral unit with the vacuum pressure container 48. It would also be possible to construct the arrangement shown in the drawing as an integral unit. Such integral units could advantageously be retrofitted.

Since certain changes may be made in the preferred embodiment described above without departing from the scope of the invention, it is intended that all matter contained in the above description be interpreted as illustrative only and not in a limiting sense.

What is claimed is:

1. Apparatus for introducing an additive from a reservoir into the fuel tank of an automotive vehicle, comprising:

pumping means comprising a fluid pressure actuated displacement pump including first and second chambers;

means for selectively connecting said first chamber to a source of fluid pressure;

first valve means for admitting additive to said second chamber in response to fluid pressure being applied to said first chamber; and second valve means for connecting said second chamber to said fuel tank in response to fluid pressure being removed from said first chamber.

2. The apparatus of claim 1, wherein said second valve means comprises third and fourth chambers, said third chamber being selectively connectable to said source of pressure and said fourth chamber connecting said second chamber to said fuel tank in response to pressure being applied to said third chamber.

3. The apparatus of claim 2, wherein means is provided for alternatingly applying said fluid pressure to said first and third chambers.

4. The apparatus of claim 3, wherein said first valve means comprises a check valve open in the direction of said second chamber.

5. The apparatus of claim 4, wherein said fluid pressure is vacuum pressure.

6. The apparatus of claim 5, wherein said means for alternatingly applying pressure to said first and third chambers comprises two-way valve means.

7. The apparatus of claim 6, wherein said two-way valve is connected between a fluid pressure reservoir and said first and third chambers.

8. The apparatus of claim 7, wherein said two-way valve means comprises a plunger selectively movable between first and second positions.

9. The apparatus of claim 8, wherein fluid pressure is applied to said first chamber when said plunger is in its said first position.

10. The apparatus of claim 9, wherein fluid pressure is applied to said third chamber when said plunger is in its said second position.

11. The apparatus of claim 10, wherein means is provided for venting said third chamber when said plunger is in its said first position.

12. The apparatus of claim 11, wherein means is provided for venting said first chamber when said plunger is in its said second position.

13. The apparatus of claim 12, wherein means is provided for moving said plunger between its said first and second positions.

14. The apparatus of claim 13, wherein said moving means comprises means for opening and closing said fuel tank.

15. The apparatus of claim 14, wherein said plunger is in its said first position when said fuel tank is closed by said moving means.

16. The apparatus of claim 15, wherein said plunger is in its said second position when said fuel tank is opened by moving means.

17. The apparatus of claim 16, wherein said moving means comprises a cap of said fuel tank.

18. An apparatus for introducing an additive from a reservoir to a fuel tank, comprising:

fluid pressure actuated displacement pump means having a first chamber selective connectable to a source of fluid pressure and a second chamber alternatingly connectable to a source of additive and said fuel tank;

first check valve means connected between said source of additive and said second chamber and open in the direction of said second chamber; and second check valve means connected between said second chamber and said fuel tank and selectively openable in the direction of said fuel tank.

19. The apparatus of claim 18, wherein said second check valve means comprises third and fourth chambers and wherein said first and third chambers are alternatingly connectable to said source of fluid pressure, said fourth chamber connects said second chamber to said fuel tank when said third chamber is connected to said source of fluid pressure.

20. The apparatus of claim 19, wherein said source of fluid pressure is a source of vacuum pressure.

* * * * *